United States Patent [19]

Nakao et al.

[11] Patent Number: 4,792,645

[45] Date of Patent: Dec. 20, 1988

[54] PROCESS FOR PRODUCING ELECTROCONDUCTIVE FIBROUS SHAPED-ARTICLES

[75] Inventors: Yukimichi Nakao, Yatabe; Kyoji Kaeriyama, Tsuchiura; Yoshio Suda, Hachioji; Tomoyuki Imai, Yatabe; Osamu Oze, Kure; Nanao Horiishi, Hiroshima, all of Japan

[73] Assignees: The Agency of Industrial Science & Technology; Toda Kogy Corp., both of Tokyo, Japan

[21] Appl. No.: 770,095

[22] Filed: Aug. 28, 1985

[30] Foreign Application Priority Data

| | | | |
|---|---|---|---|
| Sep. 3, 1984 | [JP] | Japan | 59-184069 |
| Mar. 6, 1985 | [JP] | Japan | 60-44019 |
| Mar. 6, 1985 | [JP] | Japan | 60-44020 |

[51] Int. Cl.[4] ..... B32B 15/14; C23C 28/02; D06M 11/18; D21H 1/20; H01B 5/14

[52] U.S. Cl. ..... 174/126.4; 174/126.2; 427/121; 427/123; 427/125; 427/304; 427/305; 427/306; 427/353; 427/354; 428/263; 428/378; 428/381; 428/608; 428/615; 428/624

[58] Field of Search ..... 174/126 C, 126 CP; 427/121, 123, 125, 304, 305, 306, 353, 354; 428/263, 378, 381, 608, 615, 624

[56] References Cited

U.S. PATENT DOCUMENTS

| | | | |
|---|---|---|---|
| 4,201,825 | 5/1980 | Ebneth | 428/289 |
| 4,278,435 | 7/1981 | Ebneth | 428/263 |
| 4,681,591 | 7/1987 | Okayasu et al. . | |

FOREIGN PATENT DOCUMENTS

| | | |
|---|---|---|
| 0003768 | 6/1979 | European Pat. Off. . |
| 2030694 | 1/1971 | Fed. Rep. of Germany . |
| 2743768 | 4/1977 | Fed. Rep. of Germany . |
| 2739179 | 4/1979 | Fed. Rep. of Germany . |
| 2820525 | 11/1979 | Fed. Rep. of Germany . |
| 2910460 | 5/1980 | Fed. Rep. of Germany . |
| 806977 | 1/1959 | United Kingdom . |

*Primary Examiner*—James C. Cannon

*Attorney, Agent, or Firm*—Cushman, Darby & Cushman

[57] ABSTRACT

Disclosed herein is a process for producing electroconductive fibrous shaped-articles comprising the steps of: soaking water-absorptive fibrous shaped-articles in a palladium hydrosol containing a cationic surfactant, an anionic surfactant, a non-ionic surfactant or a mixture thereof, and after (i) drying the thus treated shaped-articles, (ii) washing the thus treated shaped-articles with water or (iii) washing the thus treated shaped-articles and then drying, subjecting the thus obtained, shaped-articles on which colloidal palladium is adsorbed to chemical plating, thereby obtaining the electroconductive fibrous shaped-articles of which fibers thereof are subjected to metallizing plating.

28 Claims, 1 Drawing Sheet

PROCESS FOR PRODUCING ELECTROCONDUCTIVE FIBROUS SHAPED-ARTICLES

BACKGROUND OF THE INVENTION

The present invention relates to a process for producing electroconductive fibrous shaped-articles of which fibers thereof are subjected to metallizing plating, and more in detail, the present invention relates to a process for producing electroconductive fibrous shaped-articles of which the fibers constituting the shaped-articles are uniformly and firmly subjected to metallizing plating by chemically plating the fibrous shaped-articles after having colloidal palladium adsorbed thereonto uniformly and firmly.

Since the electroconductive fibrous shaped-articles which have been provided with electroconductivity by subjecting the fibrous shaped-articles made of paper and/or non-woven cloth to metallizing plating are lighter and less expensive than the metallic materials, the electroconductive fibrous shaped-articles are used as the material for electromagnetic shields, for preventing electrification of electronic parts such as IC and for electrostatic recording.

Although the fibrous shaped-articles made of paper and/or non-woven cloth are originally insulating materials, because the fibrous shaped-articles are lighter and cheaper than the metallic materials, the fibrous shaped-articles have been subjected to various processes of adhering several metals onto the fibrous shaped-articles, thereby providing electric properties such as electroconductivity and magnetic properties to the fibrous shaped-articles.

In this case of adhering a metal onto the fibrous shaped-articles, in order to retain the thus adhered metal stably for a long time, it is necessary that the metal is adhered to the fibrous shaped-articles as uniformly and firmly as possible, and it is demanded that the adhered metal hardly falls off on the occasion of contacting with a solid body.

The conventional process for producing such electroconductive fibrous shaped-articles comprises adhering an electroconductive powdery material such as metallic powder and/or carbon black onto the fibrous shaped-articles by using a suitable fixing agent (for instance, refer to Japanese Patent Application Laid-Open No. 57-183496 (1982)).

As the other process, there is a process wherein the fibers constituting the fibrous shaped-articles are coated with a metal, namely, a strong acidic palladium-tin colloid is adhered to the fibrous shaped-article and then the thus treated shaped-articles are subjected to electroless chemical plating, thereby obtaining the electroconductive paper (for instance, refer to German Patent No. 28 06 835).

The largest problem in the electroconductive fibrous shaped-articles according to the conventional process lies in the fact that the electroconductive powdery material or the electroconductive coating adhering to the shaped-article is apt to fall off therefrom easily on the occasion of the contact of the shaped-article with other solid bodies, particularly occurring on the outer surface of the shaped-articles.

Namely, according to the afore-mentioned process disclosed in Japanese Patent Application Laid-Open No. 57-183496 (1982), since the electroconductive powdery material only adheres on the surface of the fibrous shaped-article, it is apt to fall off on the occasion of the contact with other solid bodies. On the other hand, in the process disclosed in German Patent No. 28 06 835, it is difficult to uniformly adhere the metal on the fibrous shaped-articles, and the process has a demerit of more complicated steps.

The reason why it is difficult to uniformly adhere the metal on the fibrous shaped-articles lies in the fact that the strongly acidic palladium-tin colloid is not too stable and accordingly, the palladium-tin colloid begins to coagulate and precipitate after 3 to 4 months of the preparation of the colloid, and further the catalytic activity thereof is reduced in that period. In addition, the reason also lies in the fact that tin hydroxide disturbing the catalytic action other than palladium which acts as a catalyst in the chemical plating, is also adhered to the shaped-article in a large amount.

In order to remove impurities such as the tin hydroxide disturbing the catalytic action from the fibrous shaped-article, the fibrous shaped-article once soaked in the strongly acidic palladium-tin colloidal solution is further treated by soaking thereof in an aqueous alkaline solution. However, it is difficult to completely remove such impurities as tin hydroxide by such a procedure and such a procedure makes the steps more complicated.

Accordingly, it has been strongly demanded to offer a process for uniformly and firmly adhering the metal on the fibrous shaped-article by an extremely easy step.

In consideration of the present situation, as a result of the present inventors' studies for finding a process for providing electroconductivity to the fibrous shaped-articles, it has been found by the present inventors that by the use of a palladium hydrosol stabilized by a surfactant, it is possible to uniformly adsorb palladium into the water-absorptive fibrous shaped-article, and the fibers constituting the fibrous shaped-article can be metal-coated by chemically plating the fibrous shaped-article to which palladium has been uniformly adsorbed, and on the basis of the finding the present invention has been attained.

SUMMARY OF THE INVENTION

In an aspect of the present invention, there is provided a process for producing electroconductive fibrous shaped-articles comprising soaking water-absorptive fibrous shaped-articles in a palladium hydrosol containing a cationic surfactant, an anionic surfactant, a non-ionic surfactant or a mixture thereof and after (i) drying the thus treated shaped-articles, (ii) washing the thus treated shaped-articles with water, or (iii) washing the thus treated shaped-articles with water and drying the thus washed shaped-articles subjecting the thus treated fibrous shaped-articles on which colloidal palladium is adsorbed to chemical plating, thereby obtaining the electroconductive fibrous shaped-articles of which the fibers thereof are subjected to metallizing plating.

BRIEF EXPLANATION OF DRAWINGS

Of the attached drawings.

DETAILED EXPLANATION OF THE INVENTION

Figure 1:
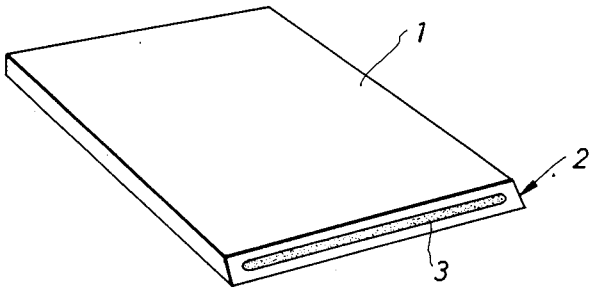
FIGS. 1 and 2 are oblique section views of the sheets of filter paper, respectively obtained in Examples 1 and 5.

The present invention relates to a process for producing electroconductive fibrous shaped-articles comprising soaking water-absorptive, fibrous shaped-articles in a palladium hydrosol containing a cationic surfactant, an anionic surfactant, a non-ionic surfactant or a mixture thereof, and after (i) drying the thus soaked fibrous shaped-articles, (ii) washing the thus soaked fibrous shaped-articles with water or (iii) washing the thus soaked fibrous shaped-articles with water and drying the thus washed fibrous shaped-articles subjecting the thus treated fibrous shaped-articles on which colloidal palladium is adsorbed to chemical plating, thereby obtaining the electroconductive fibrous shaped-articles of which fibers thereof are subjected to metallizing plating.

The characteristic feature of the present invention is in that the process comprises the steps of adsorbing a colloidal palladium contained in a palladium hydrosol which does not contain the impurities such as tin hydroxide disturbing the catalytic action for chemical plating and is stable for a long time, into the fibrous shaped-articles and chemically plating the thus treated fibrous shaped-articles.

According to the present invention, the pâlladium hydrosol which does not contain any impurities disturbing the catalytic action and is stable for a long time is prepared by making at least one of a cationic surfactant, an anionic surfactant or a non-ionic surfactant coexistent with the palladium hydrosol.

Namely, the palladium hydrosol used according to the process of the present invention is obtained by treating an aqueous solution of a palladium(II) salt, preferably an aqueous solution of palladium(II) chloride with a reductant such as sodium borohydride, dimethylamine borane and hydrazine (refer to Japanese Patent Application Laid-Open No. 59-120249 (1984)). In the reduction, the surfactant acts as a satabilizer for preventing the coagulation and precipitation of the colloidal palladium, and for that purpose, a cationic surfactant such as stearyltrimethylammonium chloride, hexadecyltrimethylammonium bromide and hexadecylpyridinium chloride, an anionic surfactant such as sodium dodecylbenzenesulfonate and sodium dodecylsulfate, or a non-ionic surfactant such as polyethylene glycol p-nonylphenyl ether may be used.

The concentration of the surfactant in the palladium hydrosol is preferably in a range of 0.002 to 1% by weight. In the case of below 0.002% by weight, it is impossible to obtain a stable palladium hydrosol. On the other hand, in the case of over 1% by weight, the stabilizing action of the surfactant is too strong and accordingly, the adsorption of the colloidal paradium to the fibrous shaped-article is carried out slowly and such a concentration of over 1% by weight is not practical.

According to the present invention, depending on the structure of the fibrous shaped-articles subjected to metallizing plating, the following three processes (A), (B) and (C) are proposed.

(A) Electroconductive fibrous shaped-articles of which the external peripheral portion shows the insulating property and only the fibers constituting the inner portion thereof are subject to metallizing plating.

In such a case, the process for producing the electroconductive fibrous shaped-articles comprises the steps of (1) soaking water-absorpitve fibrous shaped-articles in a palladium hydrosol containing 0.1 to 2 mg-atom of palladium/liter and a cationic surfactant, an anionic surfactant or a non-ionic surfactant or a mixture thereof, and (2) after (i) drying the thus soaked shaped-articles (ii) gently washing the thus soaked shaped-articles with water or (iii) gently washing the thus soaked shaped-articles with water and drying the thus washed shaped-articles, subjecting the thus treated fibrous shaped-articles on which the colloidal palladium is adsorbed to chemical plating, thereby obtaining the electroconductive fibrous shaped-articles having an insulating external peripheral portion, of which the fibers constituting the inner portion are subjected to metallizing plating.

The above-mentioned method will be more concretely explained as follows.

In the first place, the fibrous shaped-articles are soaked in the palladium hydrosol for a predetermined time and before the colloidal palladium is adsorbed onto the fibers of the shaped-articles, the shaped-articles are pulled out from the hydrosol. It is necessary to adjust the soaking time according to the material of the fibrous shaped-articles.

Namely, as the fibrous shaped-articles used according to this process of the present invention, those of from 0.01 to 20 mm in thickness showing water-absorbing property are suitable, and as the material therefor, sheets of paper and non-woven cloths made of fibers such as cellulose, regenerated cellulose, hemp, cotton, wool and synthetic fibers are used. In the case of using sheets of paper made of cellulose fibers and having a tendency of adsorbing the colloidal palladium relatively quickly, the soaking for longer than 5 min. should be avoided and the soaking should be carried out desirably for about a few seconds. On the other hand, in the case of using non-woven cloths made of synthetic fibers such as nylon and polyethylene terephthalate, because of the extremely slow adsorption of the colloidal palladium onto the fibers, it is allowed to soak such cloths for about one hour.

In either case, the concentration of palladium in the palladium hydrosol is preferably in a range of 0.1 to 2 mg-atom/liter.

After uniformly soaking the palladium hydrosol into the fibrous shaped-articles, the colloidal palladium is adsorbed only into the inner portion of the fibrous shaped-article by the following three methods.

In the first method, the fibrous shaped-articles are pulled up from the palladium hydrosol, and after removing the dripping thereof, the fibrous shaped-article is dried ordinarily by leaving the thus soaked fibrous shaped-articles in air to be air-dried, however, drying may be accelerated by heating or leaving the thus soaked fibrous shaped-articles under a reduced pressure. With the progress of drying, the adsorbed palladium hydrosol is transferred from the external peripheral portion of the shaped articles to the inner portion thereof while being concentrated, and finally fixed on the surface of the fibers in the inner portion of the fibrous shaped-articles.

In the second method, after pulling the fibrous shaped-articles up from the palladium hydrosol, the thus soaked fibrous shaped-articles are immediately and gently washed with water, preferably by soaking the thus obtained fibrous shaped-articles in water for from a few sec to about 5 min. gently. In this case, it should be avoided to stir the water or to soak for a long time. By the gentle washing with water, only the palladium hydrosol contained in the external peripheral portion is washed out resulting in the adsorption of palladium only in the inner portion of the fibrous shaped-articles.

In the third method, the above-mentioned two methods are used in combination, namely, the fibrous shaped-articles pulled out from the palladium hydrosol is gently washed with water and then dried.

Then the fibrous shaped-articles of which only the inner portion thereof has been activated by colloidal palladium are soaked in a chemical plating bath. After a definite induction period, chemical plating begins and the inner portion of the fibrous shaped-articles becomes black in colour. Although the external peripheral portion of the fibrous shaped-article remains almost white in colour without showing any colour change, the colour-change of the inner portion can be observed through the outer surface. Accordingly, at the time when the inner portion is uniformly coloured, the fibrous shaped article are pulled out from the chemical plating bath, washed with water and dried. The time necessary for chemical plating depends on the composition, pH and temperature of the chemical plating bath, and it is usually within one hour.

As a result, the fibrous shaped-article of which only the fibers of the inner portion are subjected to chemical plating is obtained.

Namely, those obtained by the first process are the electroconductive fibrous shaped-articles of which the external peripheral portion shows an insulating property and only the fibers constituting the inner portion having the thickness of from 20 to 90% of the total thickness of the fibrous shaped-article are subjected to metallizing plating.

(B) Electroconductive fibrous shaped-articles of which the fibers constituting the external peripheral portion are subjected to metallizing plating.

In such a case, the process for producing the electroconductive fibrous shaped-articles comprises the steps of (1) soaking the water-absorptive fibrous shaped-articles in a palladium hydrosol containing 0.1 to 5 mg-atom of palladium/liter and a cationic surfactant, an anionic surfactant or a non-ionic surfactant of a mixture thereof, and (2) after (i) washing the thus soaked shaped-articles with water, or (ii) washing the thus soaked shaped-articles with water and then drying the thus washed shaped-articles, subjecting the thus treated fibrous shaped-articles on which 0.001 to 0.020% by weight of colloidal palladium is adsorbed to chemical plating, thereby obtaining the electroconductive fibrous shaped-articles of which the fibers constituting the external peripheral portion thereof are subjected to metallizing plating.

In such a case, in order to adsorb the colloidal palladium only on the external peripheral portion of the fibrous shaped-articles made of, for instance, cellulose, regenerated cellulose or cotton (hereinafter referred to as the cellulosic fibrous shaped-articles), the amount of the colloidal palladium to the cellulosic fibrous shaped-articles is regulated to a range of 0.001 to 0.020% by weight, and the cellulosic fibrous shaped-articles are sufficiently washed with water to the inner portion thereof, thereby removing the not-adsorbed colloidal palladium remaining in the inner portion of the cellulosic fibrous shaped-articles.

In the case where an amount of 0.001 to 0.020% by weight of the colloidal palladium was adsorbed to the cellulosic fibrous shaped-articles, it has not yet been elucidated why the colloidal palladium is adsorbed only onto the external peripheral portion of the cellulosic fibrous shaped-articles. However, the present inventors consider that (1) the situation of adsorption of the colloidal palladium to the cellulosic fibrous shaped-articles depends on the diffusion phenomenon and the adsorption phenomenon, (2) in the first place, a uniform diffusion of the colloidal palladium from the outer surface of the cellulosic fibrous shaped-articles to the inner portion thereof is caused, (3) then the adsorption of the colloidal palladium to the cellulosic fibrous shaped-articles begins from the outer surface thereof and proceeds gradually into the inner portion thereof, (4) however, since the amount of the colloidal palladium is insufficient to be adsorbed into the inner portion of the cellulosic fibrous shaped-articles, the colloidal palladium is adsorbed only to the external peripheral portion of the cellulosic fibrous shaped articles.

In the process (B), the concentration of palladium in the palladium hydrosol is preferably in a range of from 0.1 to 5 mg-atom of palladium/liter.

In the case of below 0.1 mg-atom of paradium/liter, since the concentration of the colloidal palladium is small, it takes a long time to adsorb colloidal palladium onto the cellulosic fibrous shaped-articles and such a concentration is not practical. In the case of over 5 mg-atom of paradium/liter, it is impossible to prepare a stable palladium hydrosol.

In the process (B), the colloidal palladium is adsorbed onto the cellulosic fibrous shaped-article in an amount of 0.001 to 0.020% by weight, and in the case of below 0.001% by weight, the colloidal palladium is not adsorbed onto the external peripheral portion thereof or is apt to be unevenly adsorbed even if it is adsorbed. On the other hand, in the case of over 0.020% by weight, it is difficult to obtain the electroconductive cellulosic fibrous shaped-article as the object of the process (B).

By chemically plating the thus treated cellulosic fibrous shaped-article, the electroconductive (cellulosic) fibrous shaped-article of which the cellulosic fibers constituting the external peripheral portion thereof having a thickness of from 10 to 80% of the total thickness of the shaped-article are subjected to metallizing plating.

Further, by procedure of the process (B), comprising (a) folding the cellulosic fibrous shaped-article on itself, (b) soaking the thus folded cellulosic fibrous shaped-articles in the palladium hydrosol, and (c) washing the thus soaked shaped-articles even into the inner portion thereof with water or washing the thus soaked shaped articles even into the inner portion thereof with water and drying the thus washed shaped-articles, (d) subjecting the thus treated fibrous shaped-articles to chemical plating (in the folded state) or after unfolding the folded and treated fibrous shaped-articles, subjecting the thus unfolded fibrous shaped-articles to chemical plating, it is also possible to obtain the electroconductive cellulosic fibrous shaped-articles of which only one side of the external peripheral portion is subjected to metallizing plating.

(C) Electroconductive fibrous shaped-articles of which all the fibers thereof are subjected to metallizing plating.

In such a case, the process for producing the electroconductive fibrous shaped-articles comprises the step of soaking the water-absoptive fibrous shaped-articles in a palladium hydrosol containing from 0.01 to 5 mg-atom of palladium/liter and a cationic surfactant, an anionic surfactant or a nonionic surfactant or a mixture thereof, thereby bringing colloidal palladium into adsorption onto the surface of the fibers of the fibrous shaped-articles, and after (i) washing the thus soaked shaped-articles on which colloidal palladium is adsorbed with water or (ii) washing the thus soaked shaped-articles on which colloidal palladium has been adsorbed with water and then drying the thus washed shaped-articles, subjecting the thus treated fibrous shaped-articles on which from 0.025 to 0.20% by weight of colloidal palladium has been adsorbed to chemical plating, thereby obtaining the electroconductive fibrous shaped-articles of which all the fibers thereof are subjected to metallizing plating.

In the process (C), the adsorption of colloidal palladium on all the fibers of the fibrous shaped-articles is carried out by adjusting the amount of palladium to be adsorbed onto the fibrous shaped-articles.

In the case where over 0.025% by weight of colloidal palladium has been adsorbed, it has not been elucidated why colloidal palladium is adsorbed on all the fibers of the fibrous shaped-articles, however, the present inventors consider that (1) in the process (C), the situation of the adsorption of colloidal palladium on the fibrous shaped-articles depends on the diffusional phenomenon and the adsorptional phenomenon, (2) in the first place, a uniform diffusion of the colloidal palladium from the outer surface of the fibrous shaped-articles to the inner portion thereof is caused, (3) then the adsorption of the colloidal palladium to the fibrous shaped-articles begins from the outer surface thereof and proceeds gradually into the inner portion thereof, and (4) because of the presence of a sufficiently large amount of colloidal palladium for adsorbing onto the surface of the fibers of the inner portion of the fibrous shaped-articles, the colloidal palladium is adsorbed onto all the fibers of the fibrous shaped-articles.

The palladium hydrosol used in the process (C) preferably contains palladium at a concentration of 0.1 to 5 mg-atom of palladium/liter. In the case of below 0.1 mg-atom of palladium/liter, because of the low concentration of colloidal palladium, it takes a long period for adsorbing colloidal palladium all over the fibers of the fibrous shaped-article, and accordingly, such a low concentration is not practically applicable.

On the other hand, in the case of over 5 mg-atom of palladium/liter, it is impossible to obtain a stable palladium hydrosol.

The amount of colloidal palladium to be adsorbed onto the fibrous shaped-article in the process (C) is 0.025 to 0.20% by weight, and in the case of below 0.025% by weight, the colloidal palladium is not absorbed into the inner portion of the fibrous shaped-articles. On the other hand, in the case of not less than 0.025% by weight, the colloidal palladium is adsorbed to all over the fibers of the fibrous shaped-articles, however, it is nonsense to adsorb the colloidal palladium in the amount more than 0.20% by weight, namely, the upper limit being 0.20% by weight.

The rate of adsorption of colloidal palladium according to the process of the present invention depends on the kinds of the fibrous shaped-articles, the temperature and concentration of the palladium hydrosol and the kinds of the surfactant and accordingly, these conditions may be suitably determined corresponding to the object of the present invention. For instance, in the case where the fibrous shaped-articles are made of sheets of paper of cellulosic fiber, there is a tendency that the colloidal palladium is relatively promptly adsorbed thereto, and on the other hand, there is a tendency that the adsorption of the colloidal palladium proceeds slowly to non-woven cloths made of synthetic fibers such as nylon and polyethylene terephthalate.

The temperature of the palladium hydrosol according to the present invention may be selected in the range of 0° to 100° C. freely according to the object, and there is a tendency that the rate of adsorption of the colloidal palladium becomes larger according as the temperature becomes higher.

The rate of adsorption of the colloidal palladium depends also on the kinds of the surfactant used according to the present invention, and at 25° C. (ordinary room temperature) it is the largest in the case of using an anionic surfactant. The rate is extremely small in the case of using a non-ionic surfactant and in the case of using a cationic surfactant, the rate is between the above-mentioned two cases. However, the rate of adsorption of the colloidal palladium shows a tendency in the case of using a non-ionic surfactant that the rate of adsorption becomes much larger according as the temperature becomes higher.

In the present invention, after adsorbing the colloidal palladium to the water-absorptive fibrous shaped-articles, the thus treated fibrous shaped-articles may be subjected to chemical plating. However, in the case where an excess amount of colloidal palladium which does not participate in the adsorption is attached onto the fibrous shaped-articles, it is preferable to remove the excessive amount of colloidal palladium by washing the fibrous shaped-articles with water after the colloidal palladium is adsorbed to the fibrous shaped-articles or by washing the fibrous shaped-articles and drying the thus washed shaped-articles, because in the case where the excess amount of the colloidal palladium which does not participate in the adsorption, still adheres to the fibrous shaped-articles, the excess amount of colloidal palladium separates singly into the chemical plating bath when the thus treated fibrous shaped-articles are soaked into the chemical plating bath, and the thus singly separated colloidal palladium in the chemical plating bath causes the plating independently to the fibrous shaped-articles.

The chemical plating according to the present invention may be carried out by the ordinary steps of chemical plating. Namely, by soaking the fibrous shaped-articles on which the colloidal palladium has been adsorbed in an aqueous solution containing the metal ions for plating and a reductant, the metal ions are reduced in the parts of the fibrous shaped-articles, where colloidal palladium has been adsorbed, whereby the metal is deposited.

For the preparation of the aqueous solution of the metal ions for use in the chemical plating according to the present invention, one or more than one of metal ions ordinarily used for providing an electric- and magnetic properties, such as nickel, cobalt and copper may be used.

As the reductant for use in the chemical plating according to the present invention, sodium hypophosphite and formaldehyde may be used.

The outer surface of the electroconductive fibrous shaped-articles obtained by the process (A) is the same in colour as the untreated fibrous shaped-articles, namely, nearly white, and shows an insulating property of less than $10^{-11}$ S/cm. On the other hand, in the inner portion of the electroconductive fibrous shaped-articles, the surface of the fibers thereof is metal-coated and black in colour, and shows an electroconductivity of around $10^3$ S/cm.

Accordingly, the thus obtained fibrous shaped-articles are per se or after having been subjected to hardening treatment by a suitable resin, used broadly as the material for electromagnetic shields, heating units, magnetic recording and parts for electronic apparatuses.

In addition, as has been seen in the above, since the external appearance of the shaped-articles according to the process (A) is white in colour, it is possible to print or colour the external surface thereof and to write by pencil or pen and ink.

As for the metal-coated cellulosic fibrous shaped-articles produced by the process (B), only the external portion thereof has been subjected to chemical plating and accordingly, such shaped-articles have both the metallic property and fibrous property. Since the shaped-article is partially subjected to chemical plating, a smaller amount of the chemical plating bath is sufficient than in the case where the shaped-article is wholly subjected to chemical plating resulting in the economical use of expensive palladium, namely, it is economically profitable.

In addition, according to the present invention, since the palladium hydrosol does not contain any impurities such as tin hydroxide, etc. which disturbe the catalytic action of palladium, it is possible that the colloidal palladium is uniformly adsorbed in the external peripheral portion of the cellulosic fibrous shaped-article and accordingly, it is possible to effect the chemical plating uniformly and firmly. Consequently, the fibrous shaped-articles which are subjected to metallizing plating and are stable for a long period are available for use as the material for electromagnetic shields, for preventing electrification of electronic parts such as IC and for electrostatic recording.

As for the metal-plated fibrous shaped-articles produced according to the process (C), the whole fibers thereof are subjected to metallizing plating, and by the fact that the palladium hydrosol does not contain any impurities such as tin hydroxide, etc. which disturb the catalytic action in chemical plating, it is possible that the colloidal palladium is uniformly adsorbed into the fibrous shaped-articles. Accordingly, the product is uniformly and firmly subjected to metallizing plating, and it is suitable as the material for electromagnetic shields, for preventing electrification of electronic parts such as IC and for electrostatic recording.

The present invention will be explained more in detail while referring to the Examples as follows.

For reference, the amount of palladium of the present invention was measured by atomic absorption analytic method of the wet-type decomposition while using an atomic absorption photometer (type 508, made by HITACHI Works Co., Ltd.), and both the saturation magnetic flux density and the coercive force were measured at a magnetic field of 15 kOe. Electroconductivity was measured by four-terminal method while using a generator (model TR6141, made by TAKEDA RIKEN Co., Ltd.) and a voltmeter (model AD-5311, made by A&D Co., Ltd.).

EXAMPLE 1

Into 2.5 ml of an aqueous solution of 250 μmol of sodium chloride, 50 μmol of palladium(II) chloride were dissolved, and the solution was diluted with water into 94 ml. While stirring the thus diluted solution vigorously, one ml of an aqueous solution containing 10 mg of stearyltrimethylammonium chloride was added thereto, and then, 5 ml of an aqueous solution of 200 μmol of sodium borohydride were added to the solution drop by drop. Then the colour of the solution suddenly changed and a transparent palladium hydrosol of brownish black in colour was obtained. A sheet of filter paper (Model No. 2 made by TOYO ROSHI Co., Ltd., 0.26 mm in thickness, 4 cm in length and 4 cm in width) was soaked into the hydrosol for a few seconds and pulled out from the hydrosol, and after removing the drops from the sheet of filter paper, it was soaked in water for 5 min, and after pulling it out from water, it was air-dried for about an hour.

Separately, 0.1 mol of nickel(II) chloride was dissolved in 500 ml of an ammonia solution of 2 mol of $NH_3$/liter, and after adding thereto 500 ml of an aqueous solution of 0.2 mol/liter of sodium phosphinate, the pH of the mixed solution was adjusted to 8.9 by adding an aqueous solution of 5 mol/liter of hydrochloric acid to obtain a chemical plating bath.

After soaking the sheet of filter paper activated by colloidal palladium as mentioned above in the thus obtained liquid for chemical plating for about 30 min at room temperature, the sheet of filter paper was pulled out from the liquid, washed with water and air-dried to obtain a sheet of filter paper grayish-white in external appearance and black in the interior as is seen in FIG. 1.

In FIG. 1, 1 is the fibrous shaped-article according to the present invention, 2 is the vertical cross-section thereof and 3 is the interior thereof plated by nickel (inner portion).

The weight of the thus treated sheet of filter paper was 1.67 times larger than the weight of the original sheet of filter paper.

While the outer surface thereof showed an insulating property of less than $10^{-11}$ S/cm of electroconductivity, the inner portion thereof shows electroconductivity of $0.73\times10^3$ S/cm as converted by the weight of nickel deposited therein.

Even in either of the cases (1) where after soaking the sheet of filter paper in the palladium hydrosol, the sheet was dried and (2) where after soaking the sheet in the palladium hydrosol, the sheet was only washed with water, the treated sheet of filter paper of which the inner portion was nickel-plated was obtained.

EXAMPLE 2

An aqueous solution containing 0.05 mol of cobalt(II) sulfate heptahydrate, 0.2 mol of sodium phosphinate, 0.2 mol of trisodium citrate dihydrate and 0.5 mol of ammonium sulfate in one liter thereof was prepared by using pure water, and the pH of the solution was adjusted to 10 by adding an aqueous solution of 2 mol of $NH_3$/liter to prepare a chemical plating bath of cobalt.

A sheet of filter paper of which the inner portion has been activated by colloidal palladium by the same procedures as in Example 1 was soaked in the thus obtained chemical plating bath of cobalt, and after about one hour of soaking, the sheet was washed with water and air-dried to obtain a sheet of filter paper of which the inner portion was plated by cobalt, showed an electroconductivity and black in colour, and the outer surface was grayish white in colour and showed an insulating property.

EXAMPLE 3

Following the same procedures as in Example 1, after soaking a piece of non-woven cloth of nylon (about 2 mm in thickness, 4 cm in length and 4 cm in width, Model VF-12 made by JAPAN Vilene Co., Ltd.) into the hydrosol of palladium for one hour, it was soaked into water for 5 min to wash thereof. After soaking the thus treated piece of non-woven cloth of nylon in the chemical plating bath of nickel for one hour at room temperature, it was washed with water and air-dried to obtain a piece of non-woven cloth of nylon of which only the inner portion was plated by nickel. The outer surface thereof showed also insulating property and only the inner portion thereof showed an electroconductivity.

EXAMPLE 4

By the same procedures as in Example 3, a piece of non-woven cloth of polyethylene terephthalate (about 4 mm in thickness, 4 cm in length and 4 cm in width Model HP-55H, made by JAPAN Vilene Co., Ltd.) was treated to be a fibrous shaped-article according to the present invention, of which only the inner portion was plated by nickel. The product also showed insulating property on the outer surface thereof and electroconductivity only in the inner portion thereof.

EXAMPLE 5

Into 2.5 ml of an aqueous solution containing 250 μmol of sodium chloride, 50 μmol of palladium(II) chloride were dissolved, and the thus obtained solution was diluted to 94 ml by pure water. While vigorously stirring the thus diluted solution, 1 ml of an aqueous solution of 10 mg of stearyltrimethylammonium chloride was added to the solution, and 5 ml of an aqueous solution of 200 μmol of sodium borohydride were added to the solution. Then the colour of the solution changed suddenly, and a transparent palladium hydrosol of brownish black in colour was obtained.

A sheet of filter paper (Model No. 526 made by TOYO ROSHI Co., Ltd., 0.70 mm in thickness, 4 cm in length and 4 cm in width) was soaked in the thus prepared palladium hydrosol for 15 min at room temperature, pulled out from the hydrosol and washed with water. After analizing the thus treated sheet of filter paper by atomic absorption method, it was found that 39 μg of colloidal palladium were adsorbed onto the sheet of filter paper, which corresponded to 0.0075% by weight of the sheet of filter paper.

Separately, 0.1 mol of anhydrous nickel(II) chloride was dissolved in an aqueous solution of 4 mol of $NH_3$/liter, and after adding 500 ml of an aqueous solution of 0.2 mol of sodium phosphinate/liter to the solution, the pH of the mixture was adjusted to 8.9 by the addition of concentrated hydrochloric acid to obtain a chemical plating bath of nickel.

After soaking the above-mentioned sheet of filter paper to which colloidal palladium had been adsorbed into the thus obtained chemical plating bath of nickel for 30 min at room temperature, the thus treated sheet of filter paper was washed with water and dried.

Figure 2:
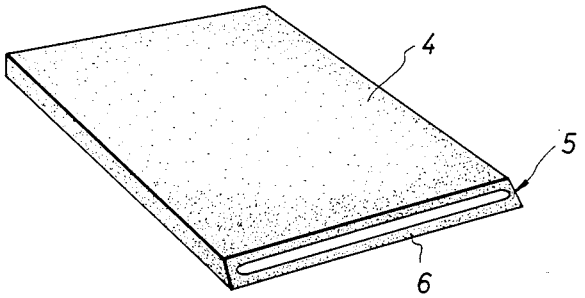

Of the thus obtained sheet of filter paper, only the outer surface presented metallic lustre with a yellowish colour as is seen in FIG. 2, and the inner portion thereof exhibits white colour which is the original colour of the sheet of filter paper. In FIG. 2, 4 is the fibrous shaped-article (a sheet of filter paper) according to the present invention, 5 is a cross-section thereof and 6 is the external portion thereof plated by nickel.

EXAMPLE 6

In the same manner as in Example 5 except for using sodium dodecylbenzenesulfonate and soaking the sheet of filter paper for 5 min, respectively instead of stearyltrimethylammonium chloride as a surfactant and soaking the sheet for 30 min in Example 5, a sheet of filter paper on which collodial palladium had been adsorbed in an amount of 73 μg of collodial palladium (corresponding to 0.014% by weight of the sheet of filter paper) was obtained.

Separately, one liter of a solution of 0.03 mol of cobalt(II) sulfate heptahydrate, 0.25 mol of sodium phosphinate, 0.50 mol of sodium tartarate dihydrate and 0.5 mol of boric acid was prepared by using pure water, and the pH thereof was adjusted to 9 by the addition of 3.3 mol of sodium hydroxide to prepare a chemical plating bath of cobalt.

Into the thus obtained chemical plating bath of cobalt, the above-mentioned sheet of filter paper to which collodial palladium had been adsorbed was soaked for 30 min at 90° C., washed with water and dried.

Of the thus obtained fibrous shaped-article (a sheet of filter paper) according to the present invention, only the outer surface presented the metallic lustre with silver-whitish color, and the inner portion exhibited white colour which was the original colour of the untreated sheet of filter paper. The electroconductivity of the product was $0.32\times10^2$ S/cm.

EXAMPLE 7

In the same manner as in Example 5 except for soaking the sheet of filter paper in the palladium hydrosol for 2 min instead of 15 min in Example 5, a sheet of filter paper on which collodial palladium had been adsorbed in an amount of 5.2 μg (corresponding to 0.001% by weight to the sheet of filter paper) was obtained. The thus treated sheet of filter paper was plated with nickel in the same manner as in Example 5.

Of the thus obtained fibrous shaped-article (a sheet of filter paper) according to the present invention, only the outer surface presented the yellowish metallic lustre due to nickel-plating, and the inner portion exhibited white colour which was the original colour of the untreated sheet of filter paper.

The electroconductivity, the saturation magnetic flux density and the coercive force of the product of Example 7 were $0.56\times10^2$ S/cm, 200 Gauss and 120 Oe, respectively.

EXAMPLE 8

In the same manner as in Example 5 except for soaking the sheet of filter paper in the palladium hydrosol for 30 min instead of 15 min in Example 5, a sheet of filter paper on which 104 μg of colloidal palladium had been adsorbed (corresponding to 0.020% by weight to the sheet of filter paper) was produced and soaked in the same chemical plating bath of cobalt as in Example 6 for 10 min at 90° C., washed with water and dried.

Of the thus obtained fibrous shaped-article (a sheet of filter paper) according to the present invention, only the outer surface presented the silver-whitish metallic lustre due to cobalt-plating, and the inner portion thereof was white in colour which is the original colour of the untreated sheet of filter paper. The saturation magnetic flux density and the coercive force of the product of Example 8 were 905 Gauss and 678 Oe, respectively.

EXAMPLE 9

One hundred ml of a solution containing 0.8 mol/liter of Rochelle salt (potassium sodium tartarate tetrahydrate), 0.8 mol/liter of sodium hydroxide and 0.5 mol/liter of copper(II) sulfate pentahydrate was prepared while using pure water, and it was mixed with 100 ml of an aqueous 35% solution of formaldehyde to prepare a chemical plating bath of copper.

Into the thus prepared chemical plating bath of copper, a sheet of type-writing paper (0.1 mm in thickness, 2 cm in length and 2 cm in width, Model TY-20 made by KOKUYO Co., Ltd.) was soaked for 30 min at room temperature, and after pulling out from the bath, the sheet was washed with water and dried. Of the thus treated sheet of type-writing paper, only the outer surface presented a reddish metallic lustre due to copper-plating, and the inner portion was white in colour which was the original colour of the sheet of type-writing paper. The electroconductivity of the product of Example 9 was $70\times10^2$ S/cm.

EXAMPLE 10

Into 2.5 ml of an aqueous solution of 250 μmol of sodium chloride, 50 μmol of palladium(II) chloride were dissolved, and the thus prepared solution was diluted to 94 ml with the addition of pure water. While vigorously stirring the thus diluted solution, one ml of an aqueous solution of 10 mg of stearyltrimethylammonium chloride was added to the above-mentioned solution, and 5 ml of an aqueous solution of 200 μmol of sodium borohydride were added dropwise to the above-mentioned solution. Then the colour of the solution was suddenly changed, and a transparent palladium hydrosol of brownish black in colour was obtained.

A sheet of filter paper (0.22 mm in thickness, 4 cm in length and 4 cm in width, Model 5A made by TOYO ROSHI Co., Ltd.) was soaked in the thus prepared palladium hydrosol for 60 min at room temperature, and after pulling thereof up from the hydrosol, it was washed with water for 5 min. On the thus obtained sheet of filter paper, colloidal palladium was adsorbed in an amount of 46 μg (corresponding to 0.030% by weight to the sheet of filter paper).

Separately, into an aqueous solution of 4 mol/liter of $NH_3$, 0.1 mol of anhydrous nickel(II) chloride was dissolved, and after adding 500 ml of an aqueous solution of 0.1 mol of sodium phosphinate to the thus formed solution, the pH of the mixture was adjusted to 8.9 by adding concentrated hydrochloric acid to prepare a chemical plating bath of nickel.

The above-mentioned, treated sheet of filter paper was soaked in the thus prepared liquid for chemical plating of nickel for 60 min at room temperature, pulled out from the bath, washed with water and dried to obtain a fibrous shaped-article (a treated sheet of filter paper) according to the present invention.

The thus obtained, treated sheet of filter paper presented a yellowish metal lustre due to nickel-plating all through the sheet, and showed the electroconductivity, saturation magnetic flux density and coercive force of $2.7\times10^3$ S/cm, 414 Gauss and 130 Oe, respectively.

EXAMPLE 11

In the same manner as in Example 10 except for using sodium dodecylbenzenesulfonate as a surfactant instead of stearyltrimethylammonium chloride in Example 10, a sheet of filter paper on which colloidal palladium had been adsorbed in an amount of 87 μg (corresponding to 0.057% by weight to the sheet of filter paper) was obtained.

Nickel-plating was carried out onto the thus treated sheet of filter paper in the same manner as in Example 10 to obtain a fibrous shaped-article which presented a yellowish metal lustre due to nickel plating all through thereof and showed the electroconductivity, saturation magnetic flux density and coercive force of $2.5\times10^3$ S/cm, 324 Gauss and 128 Oe, respectively.

EXAMPLE 12

In the same manner as in Example 10 except for carrying out the soaking at 80° C. instead of room temperature in Example 10, a sheet of filter paper on which colloidal palladium was adsorbed in an amount of 200 μg (corresponding to 0.13% by weight to the sheet of filter paper) was obtained. The thus obtained, treated sheet of filter paper was nickel-plated in the same manner as in Example 10.

The thus obtained fibrous shaped-article according to the present invention presented a yellowish metal lustre due to nickel-plating and showed the electroconductivity, saturation magnetic flux density and coercive force of $3.0\times10^3$ S/cm, 462 Gauss and 130 Oe, respectively.

EXAMPLE 13

One liter of an aqueous solution containing 0.05 mol of cobalt(II) sulfate heptahydrate, 0.2 mol of sodium phosphinate, 0.2 mol of sodium citrate dihydrate and 0.5 mol of ammonium sulfate was prepared while using pure water, and the pH of the solution was adjusted to 10 by the addition of an aqueous solution of 7.4 mol of $NH_3$/liter.

After soaking a sheet of filter paper, on which colloidal palladium had been adsorbed in the same manner as in Example 10, into the thus prepared liquid for chemical cobalt-plating for one hour at 90° C., the sheet was washed with water and dried to obtain a fibrous shaped-article according to the present invention.

The thus obtained, treated sheet of filter paper presented a silver-whitish metallic lustre due to cobalt-plating and showed the electroconductivity, saturation magnetic flux density and coercive force of $3.2\times10^3$ S/cm, 1560 Gauss and 165 Oe, respectively.

EXAMPLE 14

A palladium hydrosol was obtained in the same manner as in Example 10 except for using polyethylene glycol p-nonylphenyl ether (the degree of polyethylene glycol being 10) as the surfactant.

Into the thus prepared palladium hydrosol, a piece of non-woven cloth of nylon (about 2 mm in thickness, 4 cm in length and 4 cm in width, Model VF-12 made by JAPAN Vilene Co., Ltd.) was soaked for 60 min at 80° C., pulled out from the hydrosol, and after removing the drippings of the hydrosol, washed with water for 5 min. The thus treated piece of non-woven cloth had adsorbed 175 μg of colloidal palladium corresponding to 0.10% by weight to the piece of non-woven cloth.

The thus treated piece of non-woven cloth was subjected to nickel-plating in the same manner as in Example 10 to obtain an electroconductive fibrous shaped-article according to the present invention presenting a yellowish metallic lustre due to nickel-plating and showing an electroconductivity of from 0.08 to 0.14 S/cm.

EXAMPLE 15

One hundred ml of an aqueous solution containing 0.8 mol/liter of Rochelle salt, 0.8 mol/liter of sodium hydroxide and 0.5 mol/liter of copper(II) sulfate pentahydrate were prepared while using pure water and admixed with 100 ml of an aqueous 35% solution of formaldehyde to prepare a chemical plating bath of copper.

A sheet of filter paper on which colloidal palladium had been adbsorbed in the same manner as in Example 10 was soaked in the thus obtained chemical plating bath of copper for 60 min at room temperature, pulled out from the liquid for plating, washed with water and dried.

The thus obtained, treated sheet of filter paper presented a reddish metallic lustre due to copper-plating and showed an electroconductivity of $4.0\times10^3$ S/cm.

What is claimed is:

1. A process for producing electroconductive fibrous shaped-articles comprising the steps of:

(a) preparing a palladium hydrosol by treating an aqueous solution of a palladium (II) salt with a reductant in the presence of a least a cationic surfactant, an anionic surfactant, a non-ionic surfactant or a mixture thereof, (b) soaking a water-absorptive fibrous shaped-article in the form of paper or non-woven fabrics having the capacity to allow said palladium hydrosol to penetrate into the inner portion of the paper or non-woven fabric being soaked, (c) removing said soaked shaped-article from said palladium hydrosol and treating said soaked shaped-article by either:

(i) drying said soaked shaped-article, or (ii) washing said soaked shaped-article with water, or (iii) washing said soaked shaped-article with water and drying said washed soaked shaped-article, and (d) chemical plating said treated soaked shaped-articles of step (c), thereby obtaining electroconductive fibrous shaped-articles.

2. A process according to claim 1 wherein said palladium hydrosol has a concentration of from 0.1 to 5 mg-atom of palladium per liter and said soaked shaped-article has absorbed from 0.025 to 0.20% by weight of colloidal palladium, said removed soaked shaped-article being treated by either (a) washing said soaked shaped article with water or (b) washing said soaked shaped-article with water and then drying said washed shaped-article.

3. A process according to claim 1, wherein the concentration of said surfactant in said palladium hydrosol is 0.002 to 1% by weight thereof.

4. A process according to claim 1, wherein said cationic surfactant is stearyltrimethylammonium chloride, hexadecyltrimethylammonium bromide or hexadecylpyridinium chloride; said anionic surfactant is sodium dodecylbenzenesulfonate or sodium dodecylsulfate; and said nonionic surfactant is polyethylene glycol p-nonylphenyl ether.

5. A process according to claim 1, wherein the thickness of said water-absorptive fibrous shaped-articles is 0.01 to 20 mm.

6. A process according to claim 1, wherein said reductant is sodium borohydride, dimethylamine borane or hydrazine.

7. A process according to claim 1, wherein said chemical plating is carried out by soaking said water-absorptive fibrous shaped-articles, on which colloidal palladium is adsorbed, in an aqueous solution of metal ions containing a reductant.

8. A process according to claim 7, wherein said aqueous solution of metal ions to be subjected to metallizing plating is an aqueous neutral or alkaline solution of nickel, cobalt, copper or a mixture thereof.

9. A process according to claim 7, wherein said reductant is sodium hypophosphite or formaldehyde.

10. A process according to claim 1 wherein said palladium hydrosol has a concentration of from 0.1 to 2 mg-atom of palladium per liter and said soaked shaped-article is removed from said palladium hydrosol before colloidal palladium is absorbed onto said shaped-article.

11. A process according to claim 10, wherein said water-adsorptive fibrous shaped-articles are papers or non-woven fabrics comprising cellulose, regenerated cellulose, hemp, cotton, wool or synthetic fibers as the constituting fibers thereof.

12. A process according to claim 1 wherein said palladium hydrosol has a concentration of from 0.1 to 5 mg-atom of palladium per liter and said soaked shaped-article has absorbed from 0.001 to 0.020% by weight of colloidal palladium, said removed soaked shaped-article being treated by either (a) washing said soaked shaped-article with water or (b) washing said soaked shaped-article with water and then drying said washed shaped-article.

13. A process according to claim 12, wherein said water-absorptive fibrous shaped-articles are papers or non-woven fabrics comprising cellulose, regenerated cellulose or cotton.

14. A process according to claim 12 wherein said water-absorption fibrous shaped-article is folded prior to said soaking.

15. Electroconductive fibrous shaped-article prepared by a process comprising the steps of:

(a) preparing a palladium hydrosol by treating an aqueous solution of a palladium (II) salt with a reductant in the presence of at least a cationic surfactant, an anionic surfactant, a non-ionic surfactant or a mixture thereof, (b) soaking a water-absorptive fibrous shaped-article in the form of paper or non-woven fabrics having the capacity to allow said palladium hydrosol to penetrate into the inner portion of the paper or non-woven fabric being soaked, (c) removing said soaked shaped-article from said palladium hydrosol and treating said soaked shaped-article by either:

(i) drying said soaked shaped-article, or (ii) washing said soaked shaped-article with water, or (iii) washing said soaked shaped-article with water and drying said washed soaked shaped-article, and (d) chemical plating said treated soaked shaped-articles of step (c), thereby obtaining electroconductive fibrous shaped-articles.

16. Electroconductive fibrous shaped-article according to claim 15 wherein said palladium hydrosol has a concentration of from 0.1 to 5 mg-atom of palladium per liter and said soaked shaped-article has absorbed from 0.025 to 0.20% by weight of colloidal palladium, said removed soaked shaped-article being treated by either (a) washing said soaked shaped article with water or (b) washing said soaked shaped-article with water and then drying said washed shaped-article.

17. Electroconductive fibrous shaped-article according to claim 15 wherein said palladium hydrosol has a concentration of from 0.1 to 5 mg-atom of palladium per liter and said soaked shaped-article has absorbed from 0.001 to 0.020% by weight of colloidal palladium, said removed soaked shaped-article being treated by either (a) washing said soaked shaped-article with water or (b) washing said soaked shaped-article with water and then drying said washed shaped-article wherein said water-absorption fibrous shaped-article is folded prior to said soaking.

18. Electroconductive fibrous shaped-article according to claim 15 wherein the concentration of said surfactant in said palladium hydrosol is 0.002 to 1% by weight thereof.

19. Electroconductive fibrous shaped-article according to claim 15 wherein said cationic surfactant is stearyltrimethylammonium chloride, hexadecyltrimethylammonium bromide or hexadecylpyridinium chloride; said anionic surfactant is sodium dodecylbenzenesulfonate or sodium dodecylsulfate; and said non-ionic surfactant is polyethylene glycol p-nonylphenyl ether.

20. Electroconductive fibrous shaped-article according to claim 15 wherein the thickness of said water-absorptive fibrous shaped-articles is 0.01 to 20 mm.

21. Electroconductive fibrous shaped-article according to claim 15 wherein said reductant is sodium borohydride, dimethylamine borane or hydrazine.

22. Electroconductive fibrous shaped-article according to claim 15 wherein said palladium hydrosol has a concentration of from 0.1 to 2 mg-atom of palladium per liter and said soaked shaped-article is removed from said palladium hydrosol before colloidal palladium is absorbed onto said shaped-article.

23. Electroconductive fibrous shaped-article according to claim 22 wherein said water-absorptive fibrous shaped-articles are papers or non-woven fabrics comprising cellulose, regenerated cellulose, hemp, cotton, wool or synthetic fibers as the constituting fibers thereof.

24. Electroconductive fibrous shaped-article according to claim 15 wherein said palladium hydrosol has a concentration of from 0.1 to 5 mg-atom of palladium per liter and said soaked shaped-article has absorbed from 0.001 to 0.020% by weight of colloidal palladium, said removed soaked shaped-article being treated by either (a) washing said soaked shaped-article with water or (b) washing said soaked shaped-article with water and then drying said washed shaped-article.

25. Electroconductive fibrous shaped-article according to claim 24 wherein said water-absorptive fibrous shaped-articles are papers or non-woven fabrics comprising cellulose, regenerated cellulose or cotton.

26. Electroconductive fibrous shaped-article according to claim 15 wherein said chemical plating is carried out by soaking said water-absorptive fibrous shaped-articles, on which collodial palladium is absorbed, in an aqueous solution of metal ions containing a reductant.

27. Electroconductive fibrous shaped-article according to claim 26 wherein said aqueous solution of metal ions to be subjected to metallizing plating is an aqueous neutral or alkaline solution on nickel, cobalt, copper or a mixture thereof.

28. Electroconductive fibrous shaped-article according to claim 26 said reductant is sodium hypophosphite or formaldehyde.

* * * * *

UNITED STATES PATENT AND TRADEMARK OFFICE

CERTIFICATE OF CORRECTION

PATENT NO. : 4,792,645

DATED : December 20, 1988

INVENTOR(S) : Yukimichi NAKO, et al

It is certified that error appears in the above-identified patent and that said Letters Patent is hereby corrected as shown below:

IN THE HEADING

At section [73] Assignees:, please change

"The Agency of Industrial Science & Technology; Toda Kogy Corp., both of Tokyo, Japan"

to read:

--The Agency of Industrial Science and Technology, of Tokyo, Japan; Toda Kogyo Corp., of Hiroshima, Japan--

Signed and Sealed this

Twentieth Day of June, 1989

*Attest:*

*Attesting Officer*

DONALD J. QUIGG

*Commissioner of Patents and Trademarks*